US007037045B2

(12) United States Patent
Jones

(10) Patent No.: US 7,037,045 B2
(45) Date of Patent: May 2, 2006

(54) MODULAR TUBULAR HELICAL PIERING SYSTEM

(76) Inventor: Robert L. Jones, 29505 Golden Gate Canyon Rd., Golden, CO (US) 80403

( * ) Notice: Subject to any disclaimer, the term of this patent is extended or adjusted under 35 U.S.C. 154(b) by 0 days.

(21) Appl. No.: 10/925,483

(22) Filed: Aug. 25, 2004

(65) Prior Publication Data

US 2005/0074298 A1 Apr. 7, 2005

Related U.S. Application Data

(60) Provisional application No. 60/508,981, filed on Oct. 6, 2003.

(51) Int. Cl.
*E02D 5/56* (2006.01)

(52) U.S. Cl. ..... 405/252.1; 405/253; 405/251; 405/249

(58) Field of Classification Search ..... 405/229, 405/230, 231, 232, 242, 251, 252.1, 253
See application file for complete search history.

(56) References Cited

U.S. PATENT DOCUMENTS

| | | | | |
|---|---|---|---|---|
| 414,700 | A | | 11/1889 | Gray |
| 1,406,315 | A | | 2/1922 | Whittaker |
| 2,234,907 | A | | 3/1941 | Williams |
| 2,467,826 | A | | 4/1949 | Henderson et al. |
| 2,729,067 | A | * | 1/1956 | Patterson ..... 405/236 |
| 3,016,117 | A | | 1/1962 | Petersen |
| 3,645,055 | A | | 2/1972 | Roza |
| 3,662,436 | A | | 5/1972 | Roza |
| 3,685,301 | A | | 8/1972 | Heacox |
| 3,795,055 | A | | 3/1974 | Mahony |
| 3,810,364 | A | | 5/1974 | Johnson |
| 3,902,326 | A | | 9/1975 | Langenbach |
| 4,070,867 | A | | 1/1978 | Cassidy |
| 4,239,419 | A | | 12/1980 | Gillen, Jr. |
| 4,280,768 | A | | 7/1981 | Pardue, Jr. et al. |
| 4,290,245 | A | | 9/1981 | Pardue, Jr. et al. |
| 4,316,350 | A | | 2/1982 | Watson |
| 4,334,392 | A | | 6/1982 | Dziedzic |
| 4,634,319 | A | | 1/1987 | May |
| 4,712,957 | A | | 12/1987 | Edwards et al. |
| 4,765,777 | A | | 8/1988 | Gregory |
| 4,800,700 | A | | 1/1989 | May |
| 4,833,846 | A | | 5/1989 | McFeetors et al. |
| 4,854,782 | A | | 8/1989 | May |
| 4,911,580 | A | | 3/1990 | Gregory et al. |
| 4,979,341 | A | | 12/1990 | Norman et al. |
| 5,011,336 | A | | 4/1991 | Hamilton et al. |

(Continued)

FOREIGN PATENT DOCUMENTS

| | | |
|---|---|---|
| FR | 28.547 | 3/1925 |

(Continued)

OTHER PUBLICATIONS

Brochure of DYWIDAG-Systems International, Apr. 1993.

*Primary Examiner*—Frederick L. Lagman
(74) *Attorney, Agent, or Firm*—Dorr, Carson & Birney, P.C.

(57) ABSTRACT

A modular helical piering system employs a series of tubular shafts having a rectangular cross-section that can be secured to one another by means of couplers and removable pins inserted through holes in the shafts. A number of helical blades can also be removably secured to the shafts at desired locations by means of pins.

19 Claims, 3 Drawing Sheets

U.S. PATENT DOCUMENTS

| | | | | | |
|---|---|---|---|---|---|
| 5,013,190 | A | | 5/1991 | Green | |
| 5,066,168 | A | * | 11/1991 | Holdeman | 405/249 |
| 5,116,355 | A | | 5/1992 | Freeman | |
| 5,120,163 | A | | 6/1992 | Holdeman et al. | |
| 5,139,368 | A | | 8/1992 | Hamilton et al. | |
| 5,154,539 | A | | 10/1992 | McCown, Sr. et al. | |
| 5,171,107 | A | | 12/1992 | Hamilton et al. | |
| 5,176,472 | A | | 1/1993 | Kinder | |
| 5,213,448 | A | | 5/1993 | Seider et al. | |
| 5,217,325 | A | | 6/1993 | Freeman | |
| 5,234,287 | A | | 8/1993 | Rippe, Jr. | |
| 5,246,311 | A | | 9/1993 | West et al. | |
| 5,295,766 | A | | 3/1994 | Tiikkainen | |
| 5,336,021 | A | | 8/1994 | Freeman | |
| 5,408,788 | A | | 4/1995 | Hamilton et al. | |
| 5,433,556 | A | | 7/1995 | Freeman | |
| 5,482,407 | A | | 1/1996 | Raaf | |
| 5,570,975 | A | | 11/1996 | Reinert, Sr. | |
| 5,575,593 | A | * | 11/1996 | Raaf | 405/237 |
| 5,683,207 | A | * | 11/1997 | Mauer | 405/244 |
| 5,707,180 | A | * | 1/1998 | Vickars et al. | 405/233 |
| 5,722,798 | A | | 3/1998 | Gregory | |
| 5,800,094 | A | | 9/1998 | Jones | |
| 5,951,206 | A | | 9/1999 | Gregory | |
| 6,050,740 | A | | 4/2000 | Dziedzic | |
| 6,183,167 | B1 | | 2/2001 | Ruiz et al. | |
| 6,264,402 | B1 | * | 7/2001 | Vickars et al. | 405/239 |
| 6,352,390 | B1 | | 3/2002 | Jones | |
| 6,352,391 | B1 | | 3/2002 | Jones | |
| 6,615,554 | B1 | | 9/2003 | Rupiper | |
| 6,682,267 | B1 | | 1/2004 | Jones | |
| 2004/0028481 | A1 | * | 2/2004 | Pinkleton | 405/259.1 |
| 2005/0031418 | A1 | * | 2/2005 | Whitsett | 405/252.1 |

FOREIGN PATENT DOCUMENTS

| | | | |
|---|---|---|---|
| FR | 2 624 896 | | 6/1989 |
| JP | 405287996 | A | 11/1993 |
| JP | 406193055 | A | 7/1994 |
| WO | WO 82/00672 | | 3/1982 |

* cited by examiner

MODULAR TUBULAR HELICAL PIERING SYSTEM

RELATED APPLICATION

The present application is based on, and claims priority to the Applicant's U.S. Provisional Patent Application 60/508,981, entitled "Modular Tubular Helical Piering System," filed on Oct. 6, 2003.

BACKGROUND OF THE INVENTION

1. Field of the Invention

The present invention relates generally to the field of helical piering systems. More specifically, the present invention discloses a modular helical piering system using shafts with a generally rectangular cross-section.

2. Statement of the Problem

Piering systems have long been used to lift and stabilize foundations of structures, and also in new construction. Some systems employ piles that are driven into the ground adjacent to the foundation, while other piering systems employ helical piles that are screwed into the ground. These piles are also used to anchor structures (e.g., large antennas, or pylons for high voltage lines) that are subject to large wind loads.

Conventional helical piles have an elongated shaft with a helical bearing plate permanently attached to the shaft adjacent to its lower end. The shaft can either be solid or tubular. For example, A. B. Chance Company of Centralia, Mo., markets helical piles having a solid shaft with a substantially square cross-section. The lower end of the shaft is beveled to form a point. The helical bearing plate is welded to the lower end of the shaft adjacent to the bevel. The length of the shaft is fixed, as are the diameter and location of the helical plate. In addition, some installations require several helical plates of different diameters spaced along the shaft. All of this can result in an substantial inventory problem to ensure that the appropriate helical piles are in stock for each job, particularly due to the size and expense of these helical piles.

It is also difficult to accurately predict the length of the piles that will be required for a specific job. Helical pilings are typically screwed into the ground to a point at which a predetermined torque limit is reached. It is difficult to predict what the depth of insertion will be when this torque limit is reached due primarily to the unpredictable nature of local soil conditions. Therefore, it is often necessary to add an extension to the shaft of the helical pile. For example, A. B. Chance Company markets an extension shaft having a square socket that fits over the upper end of the helical pile shaft. A bolt can be passed through aligned holes in the socket of the extension shaft and the upper end of the helical pile shaft to secure the extension shaft to the helical pile. A problem arises if the shaft of the helical pile is too long. In this case, the upper end of the shaft must be cut off and a new hole must be drilled through the shaft to secure the shaft to the support bracket needed to engage the foundation. This can be difficult and time-consuming in the field, particularly when dealing with a solid shaft.

Thus, a need exists for a helical piling system that is modular in design so that helical blades of various sizes and diameters can be used interchangeably, and various helical blades can be interchangeably combined with a shaft of a desired length. In addition, there is a need to be able to quickly and easily connect shafts to one another in the field to create a shaft assembly of a desired length.

Solution to the Problem. Nothing in the prior art teaches or suggests a modular helical piling system with tubular shafts having a rectangular cross-section that can be secured to one another in series by means of removable pins inserted through holes in the shafts. In addition, one or more helical blades can be readily secured to the shafts at desired locations by means of such pins. This modular approach allows the length of the shaft assembly and placement of the helical blades to be readily customized in the field to meet the specific needs of each job.

SUMMARY OF THE INVENTION

This invention provides a modular helical piering system using a series of tubular shafts having a rectangular cross-section that can be secured to one another by means of couplers and removable pins inserted through holes in the shafts. A number of helical blades can also be removably secured to the shafts at desired locations by means of pins.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
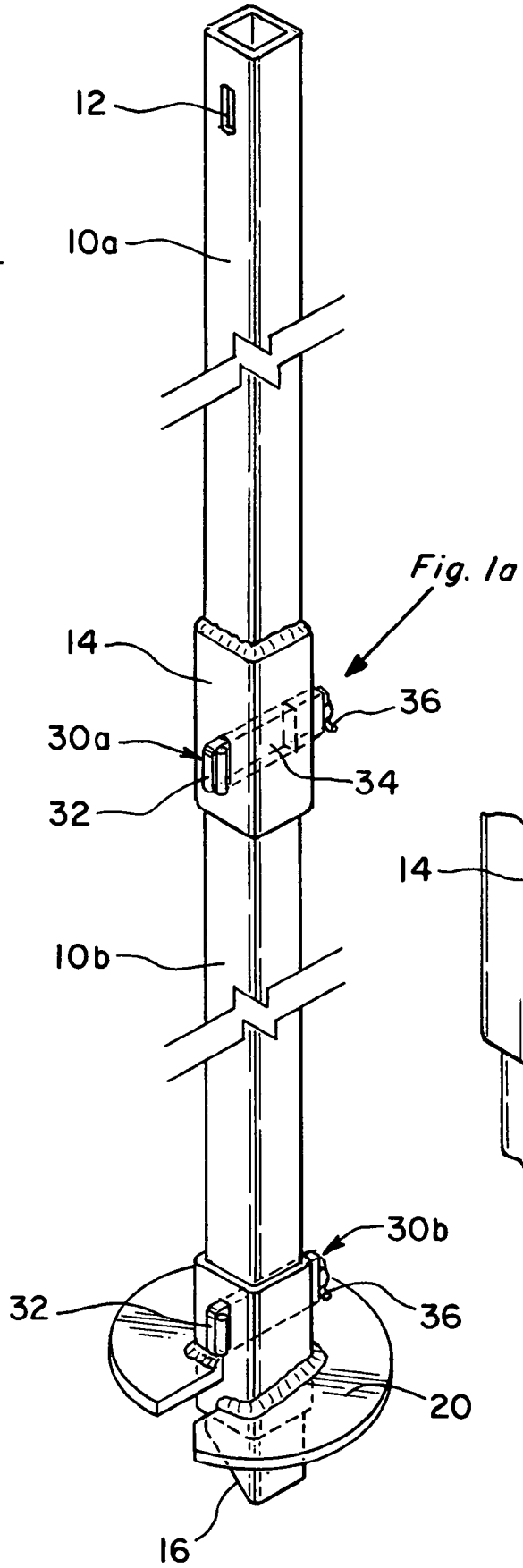
FIG. 1 is a perspective view of an assembled helical pier.
Figure 2:
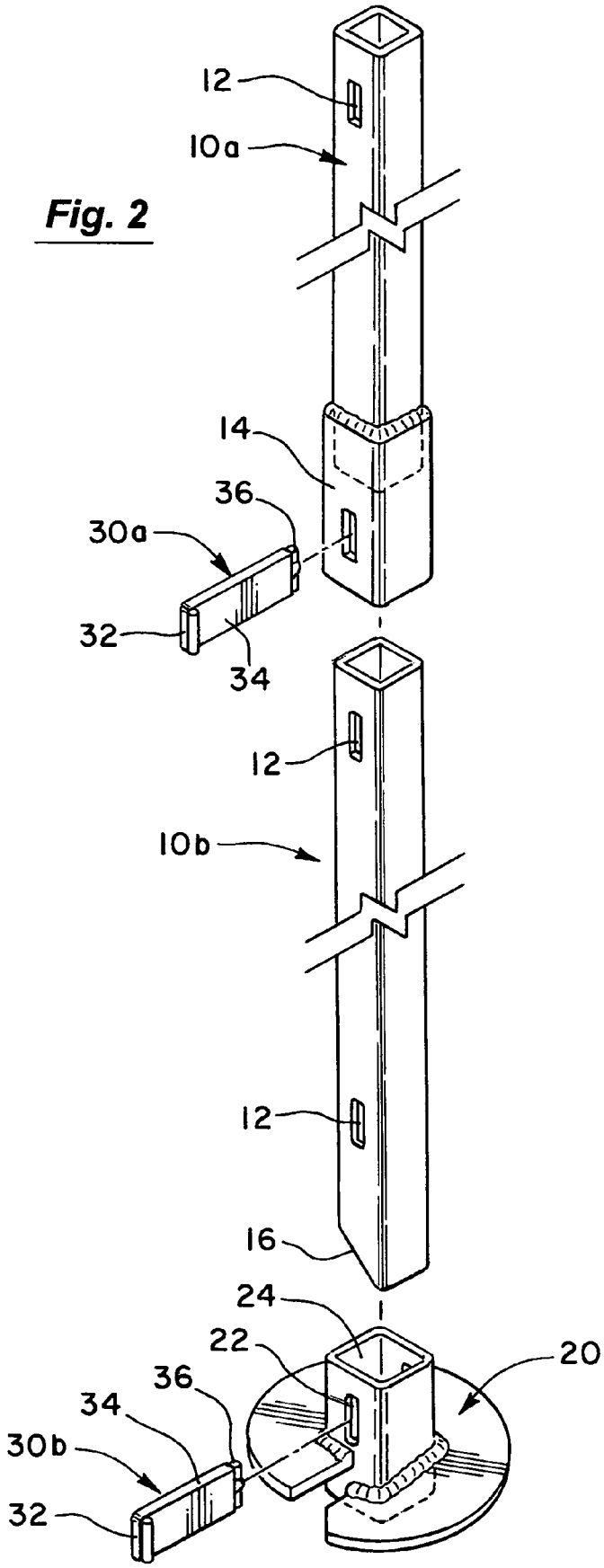
FIG. 2 is an exploded view of the helical pier corresponding to FIG. 1.

Turning to FIG. 1, a perspective view is provided showing one possible embodiment of the assembled helical piering system. FIG. 2 offers a corresponding exploded view of this assembly. Each shaft 10*a*, 10*b* is a hollow tube with a generally rectangular or square cross-section. In this embodiment, the shafts 10*a*, 10*b* have slightly rounded corners. The lower end 16 of the bottom shaft 10*b* can be beveled as shown in FIGS. 1 and 2 to form a point.

A number of holes 12 pass through the shaft wall. The holes 12 are typically aligned in pairs so that a pin 30 can be inserted horizontally through the opposing walls of a shaft 10. However, single holes or other patterns of holes could be employed. In the preferred embodiment, the holes 12 are elongated slots, which allow use of a wider pin for greater strength. However, holes of any desired shape and dimension could be used corresponding to the shape and size of the pins. Sets of holes 12 are typically placed near both ends of the shaft to facilitate coupling the shafts 10*a*, 10*b* together in series. Additional holes can be placed along the shaft, for example, to allow a helical blade 20 to be attached to the shaft.

Any number of shafts 10*a*, 10*b* can be connected together in series to achieved a desired length by means of couplers 14 at the ends of the shafts. The coupler 14 can either be permanently attached to one shaft 10*a* as shown in the drawings, or it can be a separate component that must be secured to both shafts 10*a* and 10*b* by pins. For example, the embodiment depicted in FIGS. 1 and 3 employs a coupler 14 has dimensions slightly larger than those of the shaft, so the lower end of the coupler 14 forms a socket that fits over the end of the adjacent shaft 10*b*. The rectangular cross-section and corners of the socket of the coupler 14 effectively transmit torque to the adjacent shaft 10*b* and prevent relative rotation between adjacent shafts. Alternatively, the coupler 14 could fit inside one or both of the shafts 10*a*, 10*b*.

Figure 1A:
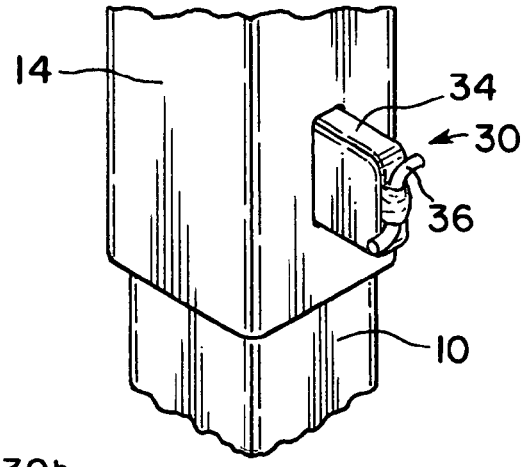
FIG. 1*a* is a detail perspective view of a pin 30 after its retaining wire 36 has been bent to hold the pin in place.

After the coupler 14 and its adjacent shaft 10*b* have been fitted together so that their respective holes are axially aligned, a removable pin 30*a* is inserted through the holes in the coupler 14 and shaft 10*b* to hold the assembly together. This process can be repeated to fasten together as many shaft segments as are needed for a particular job. In the embodiment shown in the drawings, the pin has a head 32 and a generally rectangular body 34 designed for insertion through corresponding rectangular slots 12 in the shafts 10*a*, 10*b*. A retaining wire 36 is attached to the front face of the pin. As illustrated in the detail perspective view shown in FIG. 1*a*, the retaining wire 36 can be bent or deformed to hold the pin 30 in place after insertion. The retaining wire 36 can also be bent back out of the way to allow the pin 30 to be removed.

Figure 3:
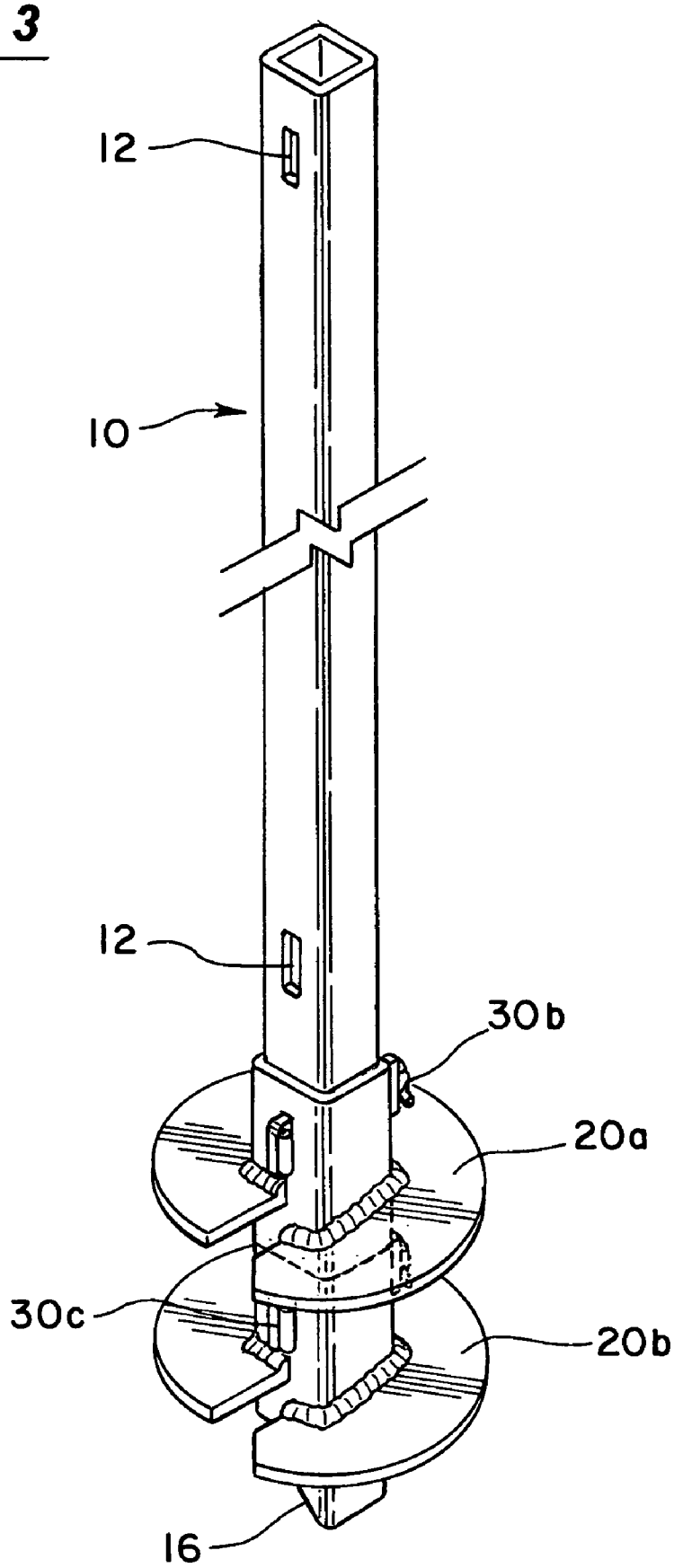
FIG. 3 is a perspective view of a shaft 10 with two helical blades 20*a* and 20*b* attached.

A number of helical blades 20 can be removably secured to the shafts 10*a*, 10*b* in a similar manner with pins 30. FIGS. 1 and 2 illustrate a single helical blade 20 secured to a shaft assembly. FIG. 3 is a perspective view of a shaft 10 with two helical blades 20*a* and 20*b* attached. As shown in FIG. 2, each helical blade 20 has an axial passageway 24 with a rectangular cross-section to receive a shaft 10*b*. The hub of the helical blade 20 also includes a number of holes or slots 22 to receive a pin 30*b*. As with the coupler 14, the holes 22 are preferably aligned in pairs so that a pin 30*b* can be inserted horizontally through both opposing walls of the hub of the helical blade 20. Alternatively, single holes or other patterns of holes could be employed. In addition, holes 22 can have any desired shape and dimensions corresponding to the shape and size of the pins.

To attach a helical blade 20, the shaft 10*b* is first inserted through the passageway 24 in the hub of the helical blade 20 so that the helical blade 20 can slide freely along the length of the shaft 10*b*. The helical blade 20 is moved along the shaft 10*b* until the holes 22 in the helical blade 20 are aligned with the desired holes 12 in the shaft 10*b*. A pin 30*b* is then inserted through the helical blade 20 and shaft 10*b* to hold the assembly together. The retaining wire 36 on the pin 30*b* can be bent to prevent the pin from accidentally falling out.

The present invention allows modular combinations of shafts and helical blades to be readily configured in the field to meet the specific needs of each job. This offers many advantages over conventional helical piers, including helical piers made from pipe. The rectangular cross-sectional shape of the shafts can handle larger torsional loads during installation of the pier. These torsional loads are carried primary by the corners of the shafts, rather than being transmitted by the pins. Installation of piers is also faster and easier because shafts and helical blades can be added as needed, and the shafts can be driven directly by the square drive tool socket commonly used in the industry. It is also easier to rotationally align the shaft segments during installation due to their rectangular cross-section, which allows only one or two possible rotational configurations between adjacent shaft segments. In contrast, conventional helical piering systems often require careful rotational alignment of multiple holes before bolts can be inserted.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A modular helical piering system comprising:

a plurality of tubular shafts, each shaft having a substantially rectangular cross-section with first and second ends and holes adjacent to the ends of the shaft; said first end receiving the second end of an adjacent shaft with the hole in the first end aligned with the hole in the second end of the adjacent shaft and the corners of the first end engaging the corners of the second end of the adjacent shaft;

a first pin removably insertable through the aligned holes in the ends of the shafts;

a helical blade having a hub with an axial passageway having a substantially rectangular cross-section to receive an end of a shaft, said hub further having a hole for alignment with a hole in the shaft in the passageway; and a second pin removably insertable through the aligned holes in the hub of the helical blade and the shaft in the passageway of the hub.

2. The modular helical piering system of claim 1 wherein the hole in the shaft comprises an elongated slot.

3. The modular helical piering system of claim 1 wherein the hole in the shaft extends through opposing walls of the shaft.

4. The modular helical piering system of claim 1 wherein at least one of the first and second pins further comprises a bendable retaining wire preventing the pin from being withdrawn from the hole while the retaining wire is bent.

5. A modular helical piering system comprising:

a plurality of tubular shafts with each shaft having first and second ends, a substantially rectangular cross-section, and at least one hole adjacent to the first end of the shaft;

a coupler attached to the second end of a shaft having a substantially rectangular cross-section to receive and engage the first end of an adjacent shaft, said coupler further having a hole for alignment with the hole in the first end of the adjacent shaft;

a first pin removably insertable through the aligned holes in the coupler and adjacent shaft;

a helical blade having a hub with an axial passageway having a substantially rectangular cross-section to receive a shaft, said hub further having a hole for alignment with a hole of a shaft in the passageway; and a second pin removably insertable through the aligned holes in the hub of the helical blade and the shaft in the passageway of the hub.

6. The modular helical piering system of claim 5 wherein the hole in the shaft comprises an elongated slot.

7. The modular helical piering system of claim 6 wherein the first pin has a substantially rectangular cross-section.

8. The modular helical piering system of claim 5 wherein the hole in the shaft extends through opposing walls of the shaft.

9. The modular helical piering system of claim 8 wherein at least one of the first and second pins further comprises a bendable retaining wire preventing the pin from being withdrawn from the hole while the retaining wire is bent.

10. The modular helical piering system of claim 5 wherein the coupler comprises a substantially rectangular socket to fit over the first end of an adjacent shaft.

11. The modular helical piering system of claim 5 wherein the coupler fits inside the first end of an adjacent shaft.

12. The modular helical piering system of claim 5 wherein the corners of the rectangular cross-section of the coupler engage the corners of the rectangular cross-section of the first end of the adjacent shaft.

13. A modular helical piering system comprising:

a first shaft with upper and lower ends, a substantially rectangular tubular cross-section, and holes adjacent to the upper and lower ends of the first shaft;

a second shaft with upper and lower ends, a substantially rectangular tubular cross-section, and a coupler at the lower end of the second shaft having an socket with a substantially rectangular cross-section to receive and engage the upper end of an adjacent first shaft, said coupler further having a hole for alignment with the hole in the upper end of the adjacent first shaft;

a first pin removably insertable through the aligned holes in the coupler of the second shaft and the upper end of the adjacent first shaft;

a helical blade having a hub with an axial passageway having a substantially rectangular cross-section to receive the lower end of the first shaft, said hub further having a hole for alignment with a hole of the lower end of the first shaft; and a second pin removably insertable through the aligned holes in the hub of the helical blade and the lower end of the first shaft.

14. The modular helical piering system of claim 13 wherein the second shaft further comprises at least one hole adjacent to the upper end of the first shaft enabling a plurality of second shafts to be coupled together in series.

15. The modular helical piering system of claim 13 wherein the holes in the first and second shafts comprise elongated slots.

16. The modular helical piering system of claim 15 wherein the first and second pins have substantially rectangular cross-sections.

17. The modular helical piering system of claim 13 wherein the holes in the first and second shafts extend through opposing walls of the shafts.

18. The modular helical piering system of claim 13 wherein at least one of the first and second pins further comprises a bendable retaining wire preventing the pin from being withdrawn from the hole while the retaining wire is bent.

19. The modular helical piering system of claim 13 wherein the corners of the rectangular cross-section of the coupler engage the corners of the rectangular cross-section of the upper end of the adjacent first shaft.

* * * * *